US007614496B2

(12) United States Patent
Dvorak et al.

(10) Patent No.: US 7,614,496 B2
(45) Date of Patent: Nov. 10, 2009

(54) AQUEOUS SOLUTION OF AN ANALGESIC AND A DISPENSER THEREFOR

(76) Inventors: Steven Dvorak, 8400 Hempstead Rd., Houston, TX (US) 77008; Rainer Kuenzel, P.O. Box 824, Hunt, TX (US) 78024

( * ) Notice: Subject to any disclaimer, the term of this patent is extended or adjusted under 35 U.S.C. 154(b) by 479 days.

(21) Appl. No.: 11/279,100

(22) Filed: Apr. 8, 2006

(65) Prior Publication Data

US 2007/0045134 A1 Mar. 1, 2007

Related U.S. Application Data

(60) Provisional application No. 60/596,060, filed on Aug. 29, 2005.

(51) Int. Cl.
*B65D 25/08* (2006.01)
*B65D 41/04* (2006.01)

(52) U.S. Cl. ..... 206/219; 206/222; 215/329; 215/DIG. 8

(58) Field of Classification Search ..... 222/145.1, 222/83.5, 80, 81, 83, 88; 220/297, 330, 301, 220/277, 278, 255, 255.1, 256.1; 215/DIG. 8, 215/320, 329, 332, 252; 206/222, 219, 220, 206/568

See application file for complete search history.

(56) References Cited

U.S. PATENT DOCUMENTS

| | | | | |
|---|---|---|---|---|
| 3,510,021 | A * | 5/1970 | Silver | 215/256 |
| 3,809,276 | A * | 5/1974 | Landen | 215/332 |
| 5,829,608 | A * | 11/1998 | Clerget | 215/44 |
| 6,354,450 | B1 * | 3/2002 | Zielinski et al. | 215/332 |
| 6,679,375 | B1 * | 1/2004 | Coory | 206/219 |
| 6,681,958 | B2 | 1/2004 | Sorenson et al. | |
| 2003/0213709 | A1 * | 11/2003 | Gibler et al. | 206/219 |

FOREIGN PATENT DOCUMENTS

| | | | |
|---|---|---|---|
| DE | 1532424 B | * | 3/1975 |
| WO | WO 0108996 | * | 8/2001 |

* cited by examiner

*Primary Examiner*—Bryon P Gehman
*Assistant Examiner*—Kaushikkumar Desai
(74) *Attorney, Agent, or Firm*—Buskop Law Group, PC; Wendy Buskop

(57) ABSTRACT

A bottle cap is adapted to retain a quantity of an additive, such as for example aspirin or the like. The additive is retained in an isolated condition within a sealed chamber or within a bladder inside the bottle cap but in fluid communication with the liquid within the bottle, such as water. A cap with at least one downward extending protrusion is provided to breech the seal of the chamber or the bladder, thereby releasing some or all of the additive retained within the bottle cap.

4 Claims, 9 Drawing Sheets

20
21
22
24
26
30
32
34
36
42
44
50
80
82

20
22
24
26
28
30
32
34
36
38
42
44
46
48
50
52
54
56
58
60
62
66
67
68
70
72
74
76
78
80
82
4
5

100
110
110
112
114
116
116
118
121
122
124
132
11
11

100
102
104
106
108
110
110
112
114
118
120
122
124
126
10
10

FIG. 14
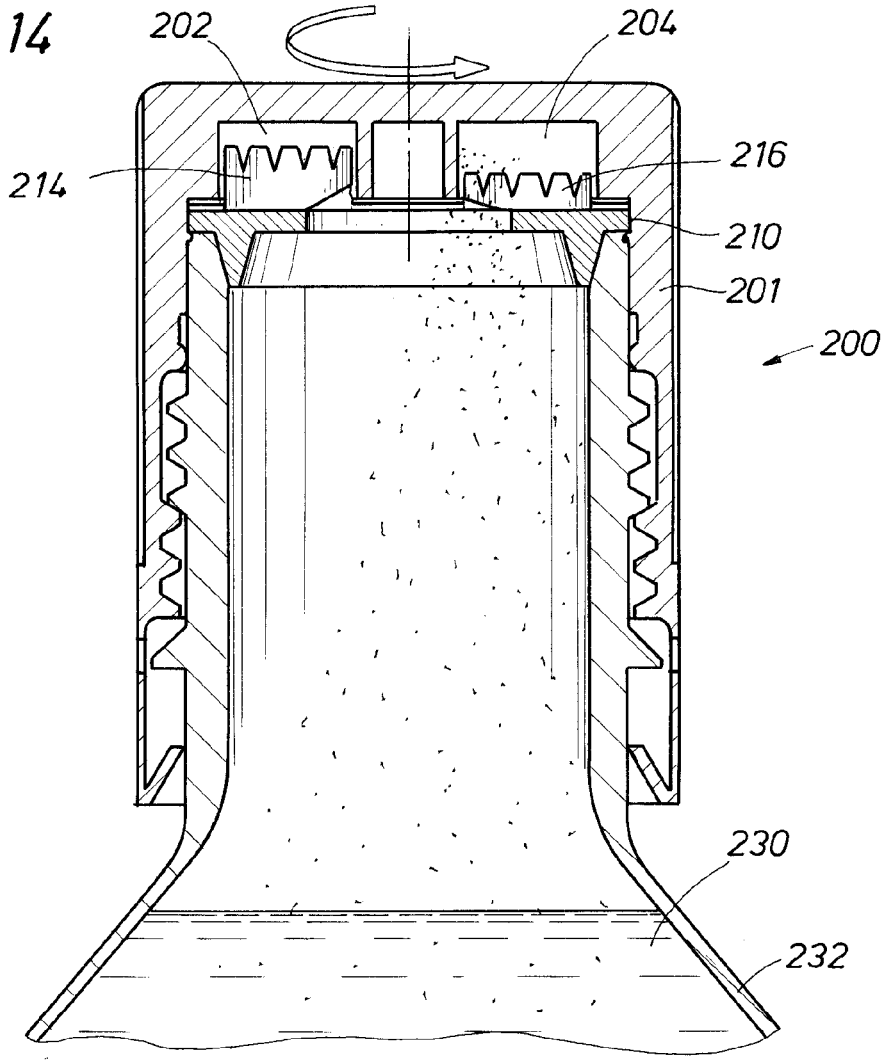
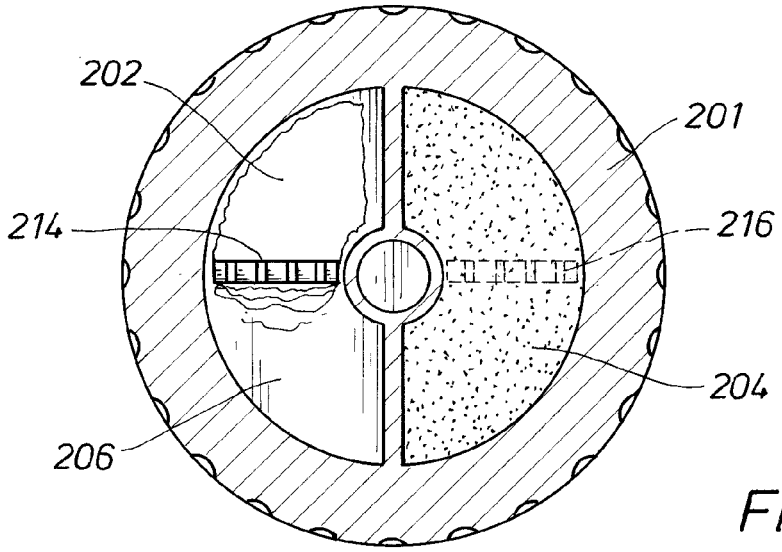
FIG. 15

AQUEOUS SOLUTION OF AN ANALGESIC AND A DISPENSER THEREFOR

This application claims the benefit of U.S. Provisional Patent Application Ser. No. 60/596,060 filed Aug. 29, 2005.

FIELD OF THE INVENTION

The present invention relates generally to the field of analgesic solutions and, more particularly, to an aqueous solution of an analgesic which is developed within a bottle prior to ingestion and to a dispenser for such an analgesic solution.

BACKGROUND OF THE INVENTION

Aspirin is the most widely used analgesic preparation in the world. It is available without prescription and is marketed under a host of trade names. It has also recently been found to have many other benefits to human health beyond its pain-relieving properties. For example, it is an anti-inflammatory agent, an anti-clotting agent for the bloodstream, a heart-health enhancer, a colon-cancer deterrent, an it may have other positive effects on the human body, which effects are currently under scientific study.

One drawback in the use of aspirin is its harsh effect on the stomach lining. Aspirin is the common name of salicylic acid, $C_9H_8O_4$. In tablet form, it poses a concentrated assault upon the stomach when swallowed. Antacid buffering agents are often incorporated in the tablets to lessen the damaging effect.

Unfortunately, the most commonly used forms of aspirin rapidly degrade in aqueous solution. Thus, if one is to gain the maximum benefit of aspirin, it must remain in a dry form immediately prior to ingestion. In response, some manufacturers provide analgesics in a power form packaged in a tear-open packet. This packet is then poured into a glass of water so that it may be dissolved and then drunk. For many active people, this is inconvenient.

A similar kind of answer to this problem was suggested by Sorenson et al. in their U.S. Pat. No. 6,681,958. That patent taught an apparatus and a method for associating a supplement compartment with a liquid container. The supplement may be a vitamin, mineral, analgesic, antibiotic or other medicine, flavor or color additive or nutritional in nature, and may be readily accessible and retrievable for use with the liquid such as water or other beverage. The compartment may be nested atop a cap that covers the dispenser of the container or may be otherwise associated with the container in a secure but temporary and accessible manner. Unfortunately, the same kind of difficulty is encountered in using this compartment, in that the user accesses the contents of the compartment, and then if it is to be dissolved in water in the dispenser, then it must be poured into the dispenser much as the packet of power is poured in.

Thus, there remains a need for a means of maintaining the efficacy of an analgesic, yet have the analgesic readily available for ingestion by the user. Such a means should minimize or at least reduce the harmful effects of the concentrated analgesic on the lining of the stomach, yet provide the helpful effects of the medical ingredients. The present invention is directed to filling this need in the art.

SUMMARY OF THE INVENTION

The present invention addresses these and other needs in the art by providing a bottle cap adapted to retain a quantity of an additive, such as for example aspirin or the like. The additive is retained in an isolated condition within a sealed chamber or within a bladder inside the bottle cap. The isolated condition of the additive is maintained by a membrane or a bladder which is fluid communication with the liquid retained within the bottle. Means are provided to breech the seal of the chamber or the bladder, thereby releasing some or all of the additive retained within the bottle cap. Thus, one feature of the present invention is the provision of a user-releasable quantity of an additive retained within a bottle cap, until released by a user.

Typical aspirin tablets contain 325 milligrams (5 grains) of aspirin compounded with various binders and fillers to permit tablet formation. Water-borne aspirin requires no such inert ingredients. Thus, the additive comprising aspirin within the bottle cap can be stored in a more concentrated form that would be available in tablet form, yet is less deleterious to the stomach of the user because it is diluted immediately prior to ingestion.

However, the additive may include a buffering agent, if desired, for example calcium carbonate, commonly used as an over the counter antacid in tablet and liquid form. Concentration in suspension with the aspirin would be sufficient to render the mixture approximately neutral pH. Calcium carbonate has been proven to offer many health benefits, including bone strength, heart health, colon health, emotional calmness, and the like.

The dispenser of the present invention may include a plastic bottle of approximately six fluid ounces. A convenient approach includes two bottles stacked "piggy-back" with the cap of the lower bottle nestled into a depression in the bottom of the upper bottle. The pair may thus be joined by an easily broken seal. This pairing reflects the usual one-or-two tablet dosage regimen recommended by both aspirin manufacturers and doctors.

Flavoring agents may be used with appropriate caution to prevent beverage use by children. The bottle cap of the present invention easily lends itself to child-proof arrangements.

These and other features and advantages of the present invention will be readily apparent to those of skill in the art from a review of the following detailed description along with the accompanying drawing figures.

BRIEF DESCRIPTION OF THE DRAWINGS

FIG. 14 is a cross-sectional view of a cap further rotated clockwise with a second compartment penetrated.

FIG. 15 is a cross-sectional view of a cap taken along sections lines 15-15 of FIG. 13.

DETAILED DESCRIPTION OF A PREFERRED EMBODIMENT

Figure 1:
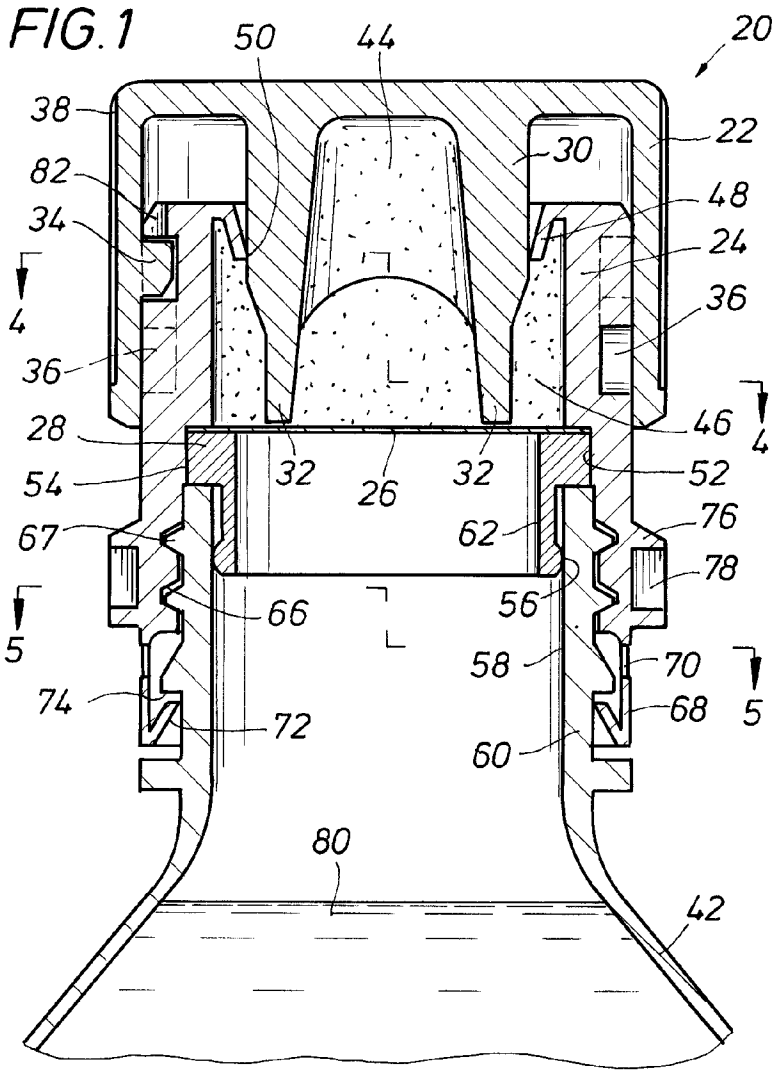
FIG. 1 is a cross-sectional view of a bottle cap, mounted on the neck of a bottle.

FIG. 1 depicts a bottle cap 20 defining a dispenser of an analgesic in accordance with the teachings of the present invention. The cap 20 primarily comprises an outer cap 22, an inner cap 24, a membrane 26 adjoining the inner cap 24, and a seal ring 28. The outer cap 22 has an inner concentric barrel 30 which is equipped with two downwardly extending protrusions or teeth 32 and three inwardly extending protrusions 34, which are shown and described below also in respect of FIG. 4. Inwardly extending protrusions 34 engage opposing J-shaped slots 36 (See FIG. 4 and FIG. 6). The outer surface of outer cap 22 is provided with a plurality of laterally extending grooves 38, providing a gripping surface on the outside of the outer cap 22. The barrel 30 is hollow to provide a chamber or cavity 44 for the storage of an analgesic powder, or other powdered substance, which is to be dissolved into water 80 stored in a bottle 42.

The inner cap 24 is also hollow to provide a chamber or cavity 46 for extra contents of the powdered additive. The upper end of the cavity 46 is sealed by a molded lip 48, which presses with an innermost edge 50 against the barrel 30. The lower end of the cavity 46 is closed by the membrane 26.

The seal ring 28 defines a flange portion 54 which is press fit into an enlarged cavity 52 of the inner cap 24. The seal ring also defines a lower extension 62 which includes a rounded seal 56, which engages an inner surface 58 of a bottle neck 60. The seal 56 is molded for an interference fit inside the bottle neck 60, but is flexible enough to slide along the surface 58 because of the relatively thin wall of the lower extension 62 that extends between the seal and the upper ring 54.

The inner cap 24 is equipped with female threads 66, which engage male threads 67 at the upper end of the bottle neck 60. Together, the threads 66 and 67 define a threaded interface between the cap 20 and the neck of the bottle. The lower end of the inner cap 24 is equipped with a thin wall portion 68, which is perforated by holes 70 (See also FIG. 5) to provide an easily broken section of the inner cap. The thin wall portion 68 provides an indication that the cap assembly 20 has been previously removed from the bottle, thus providing a tamper indicator. An upward pointing lip 72 engages the bottle neck 60 under a shoulder 74. The thin wall portion 68 breaks away at the holes 70 when the bottle is opened, providing a safety indication as to whether or not the contents of the bottle have been tampered with.

Figure 5:
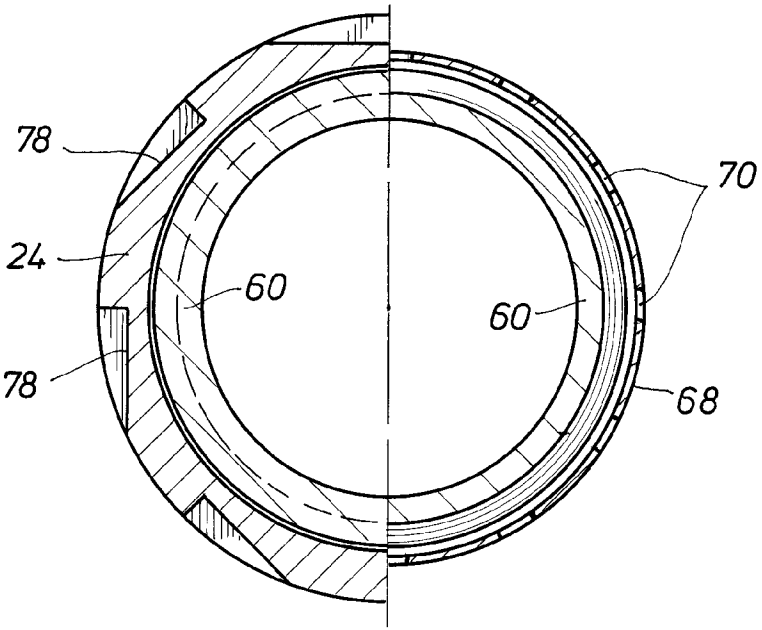
FIG. 5 is a cross-sectional view of a bottle cap taken along section lines 5-5 of FIG. 1.

An enlarged ring portion 76 of the inner cap 24 is equipped with a plurality of angled recesses 78, which serve to transmit torque when the pre-assembled cap 20 is being installed onto the neck of a bottle (see also FIG. 5).

Figure 2:
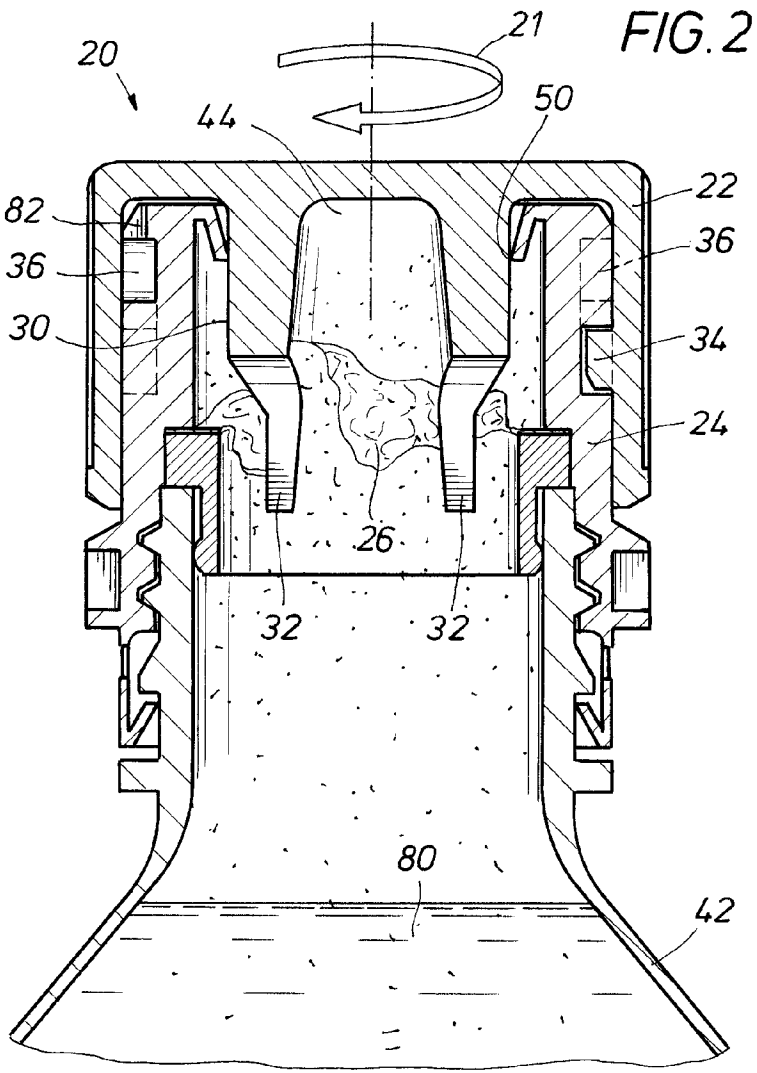
FIG. 2 is a cross-sectional view of the cap, rotated clockwise, penetrating a membrane containing an analgesic.

FIG. 2 illustrates the first step in the actuation of the cap 20 of this invention. The outer cap 22 has been rotated clockwise as shown by an arrow 21. The protrusions 34 have engaged the inside of the J-slots 36, thereby moving the outer cap down relative to the inner cap 24. The teeth 32 have penetrated the membrane 26. With the membrane 26 essentially swept aside by the action of the teeth, the contents of the chambers 44 and 46 are free to flow downward into the fluid contents 80 of the bottle 42. At this point, the user may choose to shake the bottle in order to more thoroughly dissolve the additive in the water within the bottle.

Figure 3:
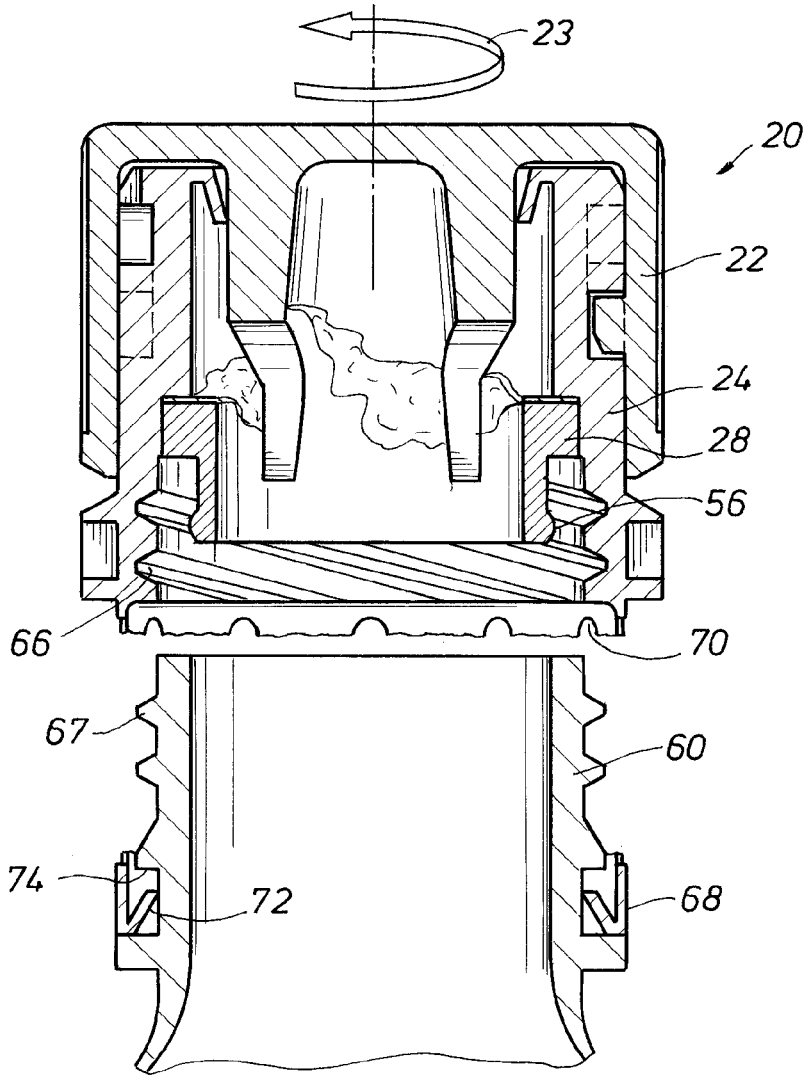
FIG. 3 is a cross-sectional view of a bottle cap being removed from a bottle.

In the next step in the operation of this invention, to open the bottle, the cap 20 is rotated counter-clockwise, as shown by an arrow in FIG. 3. The lip 72 gets caught under the shoulder 74, thin wall portion 68 breaks at the holes 70, and the rest of the cap 20 remains assembled as it is unscrewed from the bottle neck 60.

Figure 4:
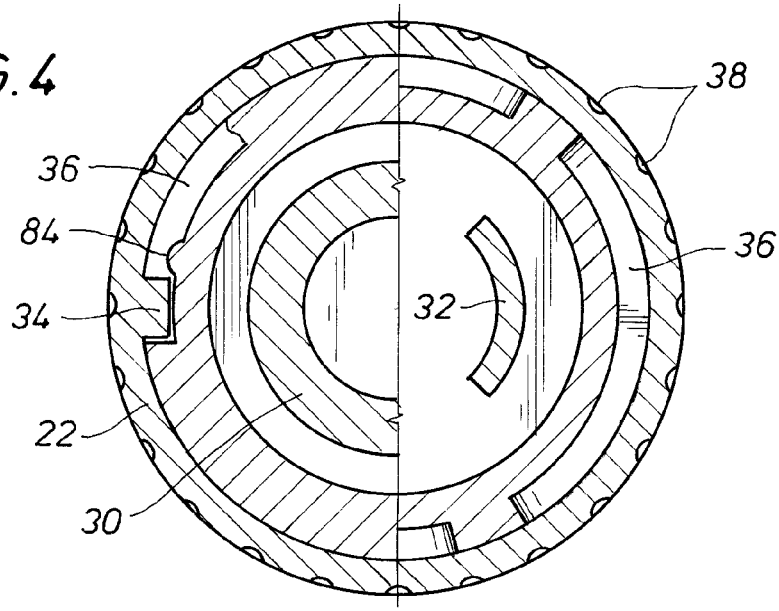
FIG. 4 is a cross-sectional view of a bottle cap taken along section lines 4-4 of FIG. 1.
Figure 6:
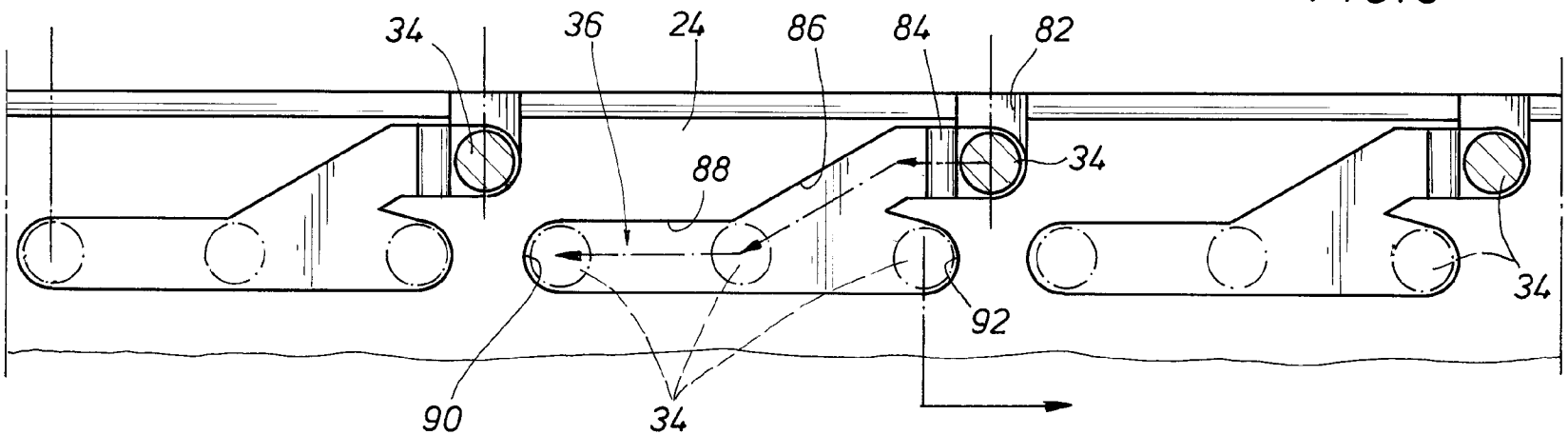
FIG. 6 is a detail view of the structure within a bottle cap.
Figure 8:
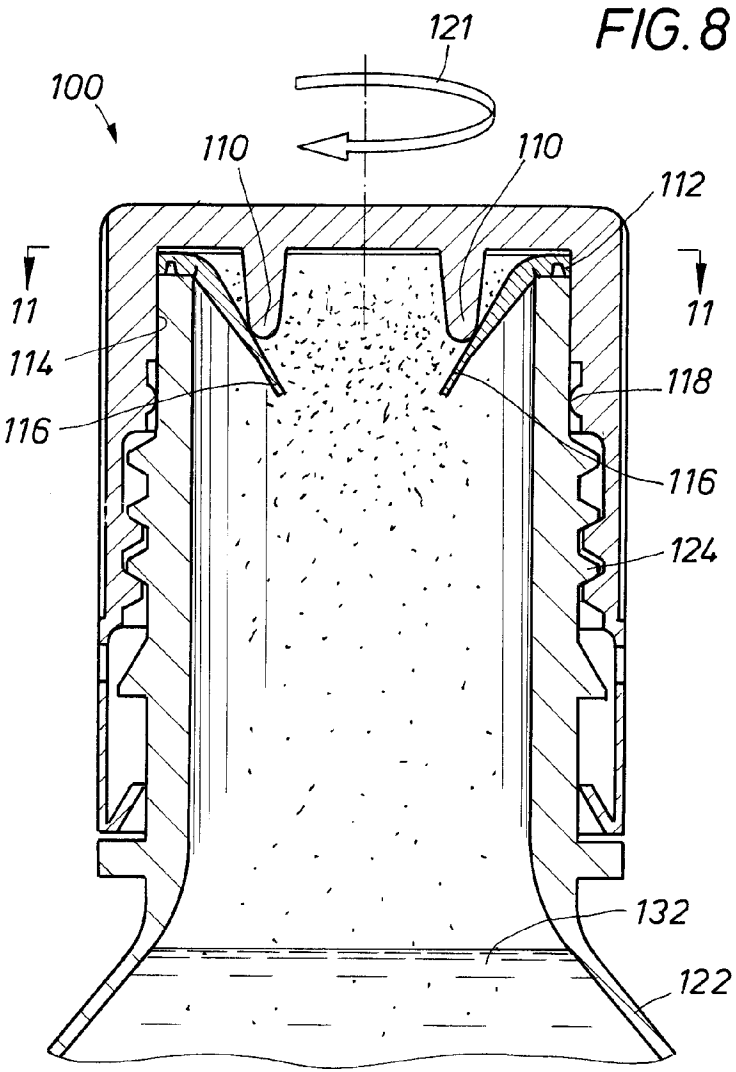
FIG. 8 is a cross-sectional view of a bottle cap rotated clockwise, breaking a scored separation plate and pushing down the segments of the separation plate.
Figure 7:
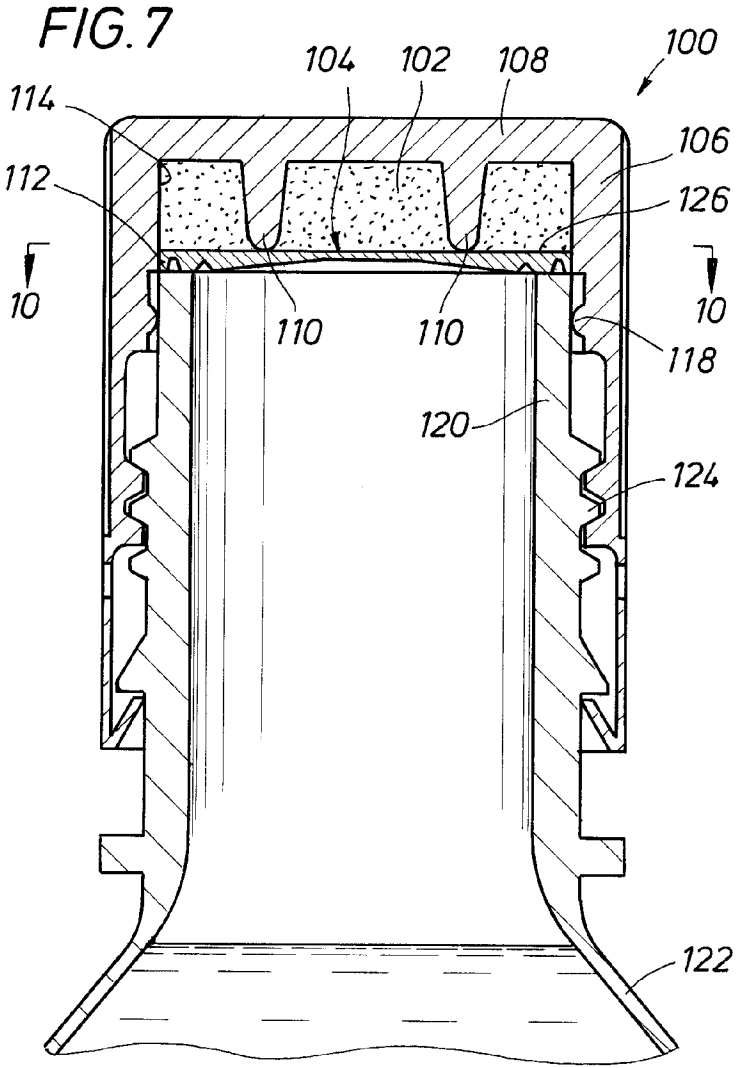
FIG. 7 is a cross-sectional view of another preferred embodiment, the a membrane formed of a molded breakable plate.

Now referring to FIGS. 4 and 6, the inwardly extending protrusions 34 of the outer cap 22 are shown in their position after assembling the cap 20. To reduce the force necessary to push the outer cap 22 down over the inner cap 24, entry ramps 82 are provided. To avoid accidental clockwise rotation of the outer cap 22, knuckles 84 have to be overcome, thus assuring a certain amount of minimum clockwise torque before protrusions 34 can enter the downward part 86 of the J-slot 36. Once the protrusions 34 reach slots 88, membrane 26 has been penetrated by the teeth 32. Further clockwise rotation of the outer cap 22 allows the protrusions 34 to move to the end 90 of the slot 88 and teeth 32 to tear open the membrane 26.

Subsequent counter-clockwise rotation of the cap 22 moves the protrusions 34 to the opposite end 92 of the slot 88, from which point on the counter-clockwise torque is transmitted into the inner cap 24 to unscrew it from the bottle neck 60.

FIG. 5 shows a top down section view of the coupling joint between the inner cap 24 and the bottle neck 60, taken along section lines 5-5 of FIG. 1. Here, the angled recesses 78 can be seen more clearly. The recesses 78 are engaged by an assembly tool (not shown) in order to insert the cap structure 20 onto the bottle 42, without disturbing the contents or structure of the cap 20.

Figure 9:
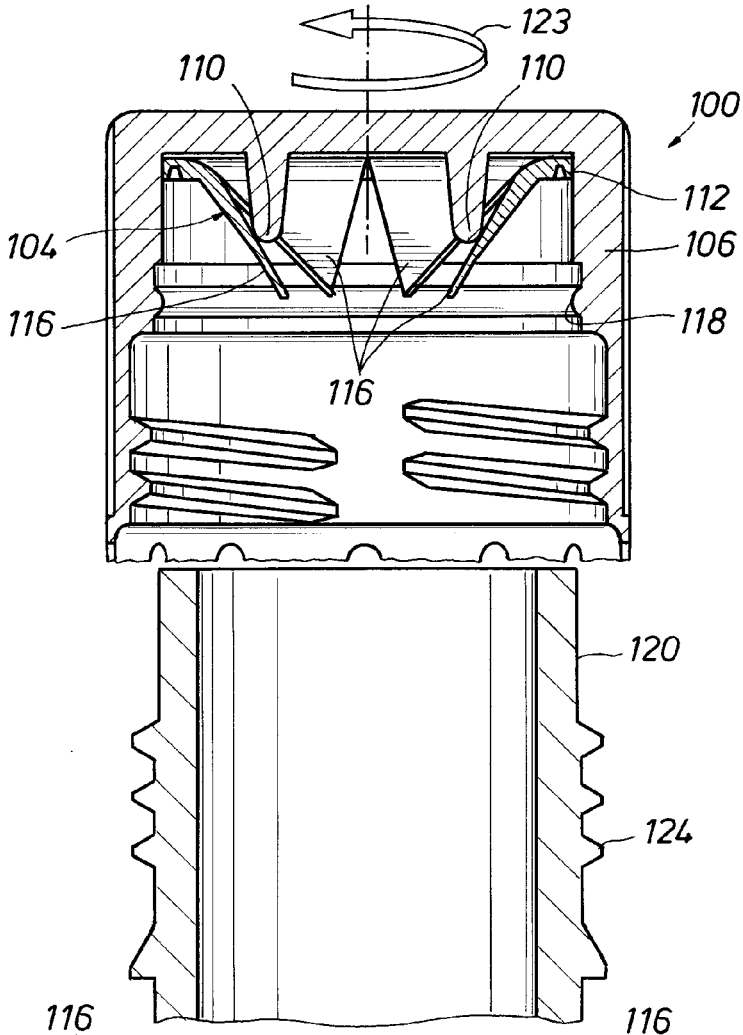
FIG. 9 is a cross-sectional view of a cap unscrewed from a bottle.
Figure 10:
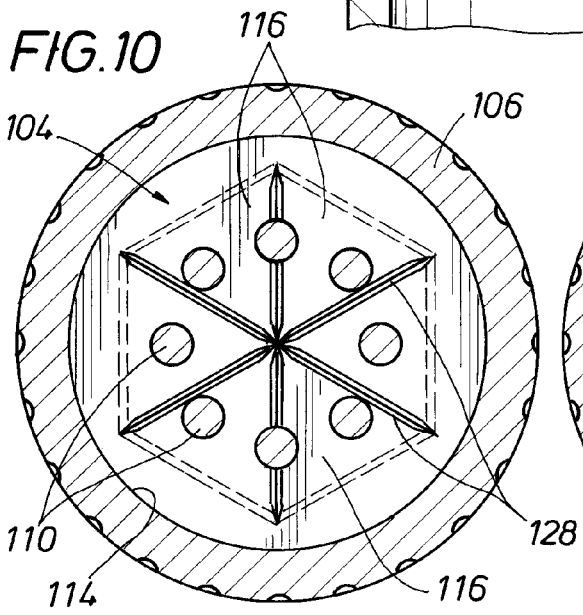
FIG. 10 is a cross-sectional view taken along section lines 10-10 of FIG. 7.
Figure 11:
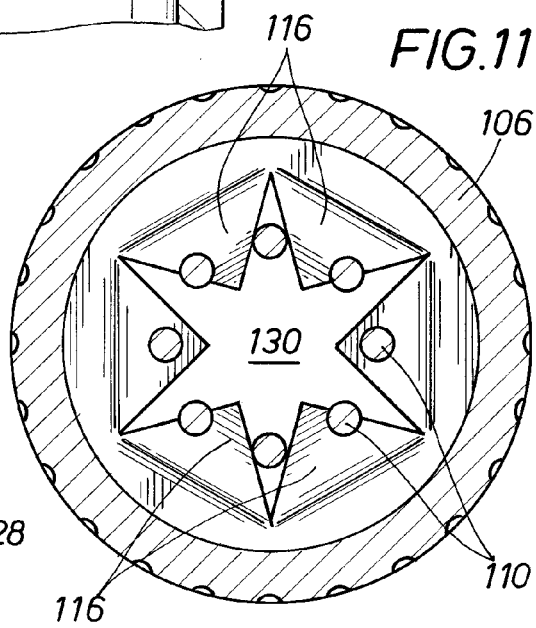
FIG. 11 is a cross-sectional view taken along sections lines 11-11 of FIG. 8.

FIGS. 7 through 11 illustrate another preferred design of a cap assembly 100 this invention. A cap 106 defines a cavity 102, which contains the desired additive, which can be in powder or liquid form. The cavity 102 is sealed by a molded plate 104. Protruding downward from a top plate 108 of the cap 106 are a plurality of knuckles 110, which are long enough to almost touch the plate 104. The plate 104 is equipped with a surrounding lip 112, which engages an inner surface 114 of the cap 106. Furthermore, the plate 104 is scored into segments 116, preferably six such segments, as shown in FIG. 10, with score lines 128. A sealing bead 118 engages the bottle neck 120 of a bottle 122.

By applying clockwise torque to the cap 106 as shown by an arrow 121, the cap 106 moves down on the bottle neck 120 by way of threads 124, an outer ring region 126 of the plate 104 is pushed up by the bottle neck 120, while the sealing lip 112 slides along the surface 114. Note the position of the sealing lip 112 just under the bottom surface on the cap 106 in FIG. 8. During this motion, the plate 104 engages the knuckles 110 and the segments 116 break apart along score lines 128 and the segment bend down and away from each other. With the segments now separated by the score line, a large opening 130 is created and the additives contained in the cavity 102 are emptied into a liquid 132 in the bottle 122.

FIG. 9 illustrates the cap assembly 100 unscrewed from the bottle neck 120, with the plate 104 remaining in its uppermost position, by the application of counter-clockwise torque as shown by an arrow 123.

FIGS. 12 through 15 illustrate another preferred embodiment of this invention, providing two compartments 202 and 204 for additives. The compartments 202 and 204 may retain the same material, to double its strength, if desired, or the compartments may store different materials, either in powder or in liquid form.

A cap assembly 200 is defined by a cap 201, which is divided in its upper end into two compartments 202 and 204. The compartments 202 and 204 are sealed against the underside of the cap 200 by a membrane 206. A cavity 208 is provided beneath the membrane 206 and the cavity 208 is further defined at its bottom by a ring plate 210. The ring plate 210 is slidably mounted inside a cylindrical surface 212 of the cap 201, which also serves as the vertical wall of the cavity 208. On top of the ring plate 210 are two cutting blades 214 and 216, which are different in height, the higher one 214 in close proximity to the membrane 206.

A conical protrusion 218 extends below the underside of the ring plate 210. The conical protrusion 218 engages a conical mating chamfer 220 inside a bottle neck 222.

Figure 13:
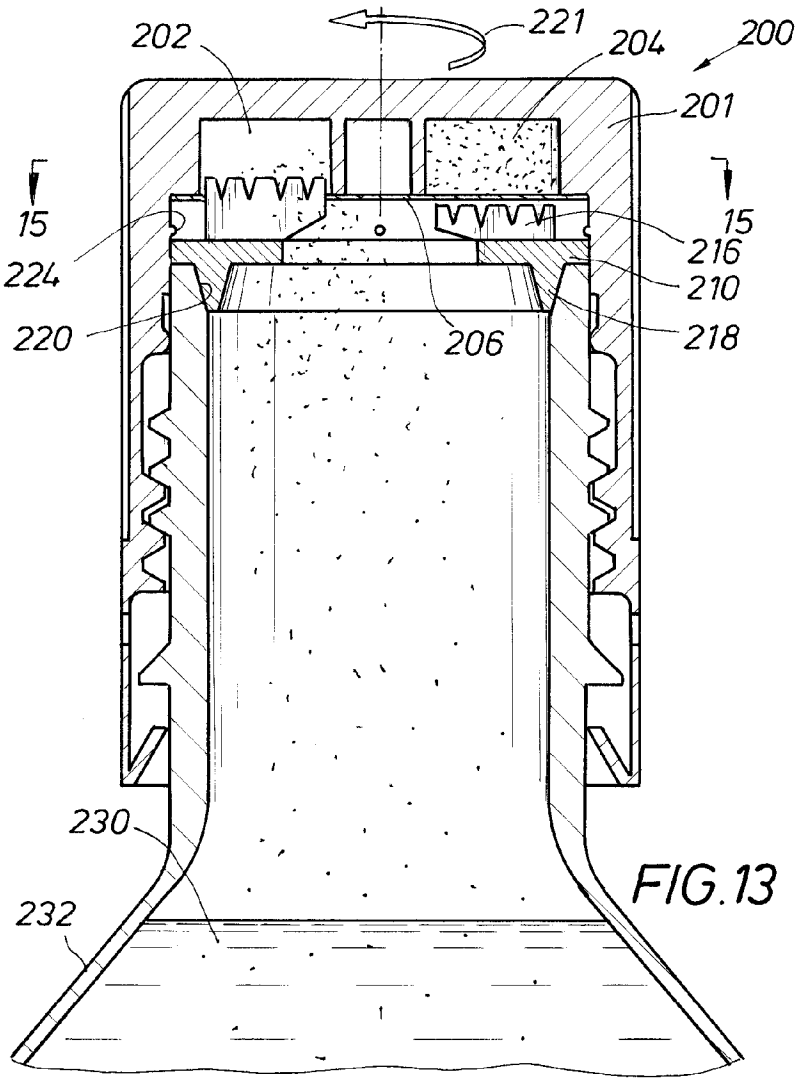
FIG. 13 is a cross-sectional view of a cap rotated clockwise with the first of two compartments penetrated and the contents of the first compartment released.
Figure 12:
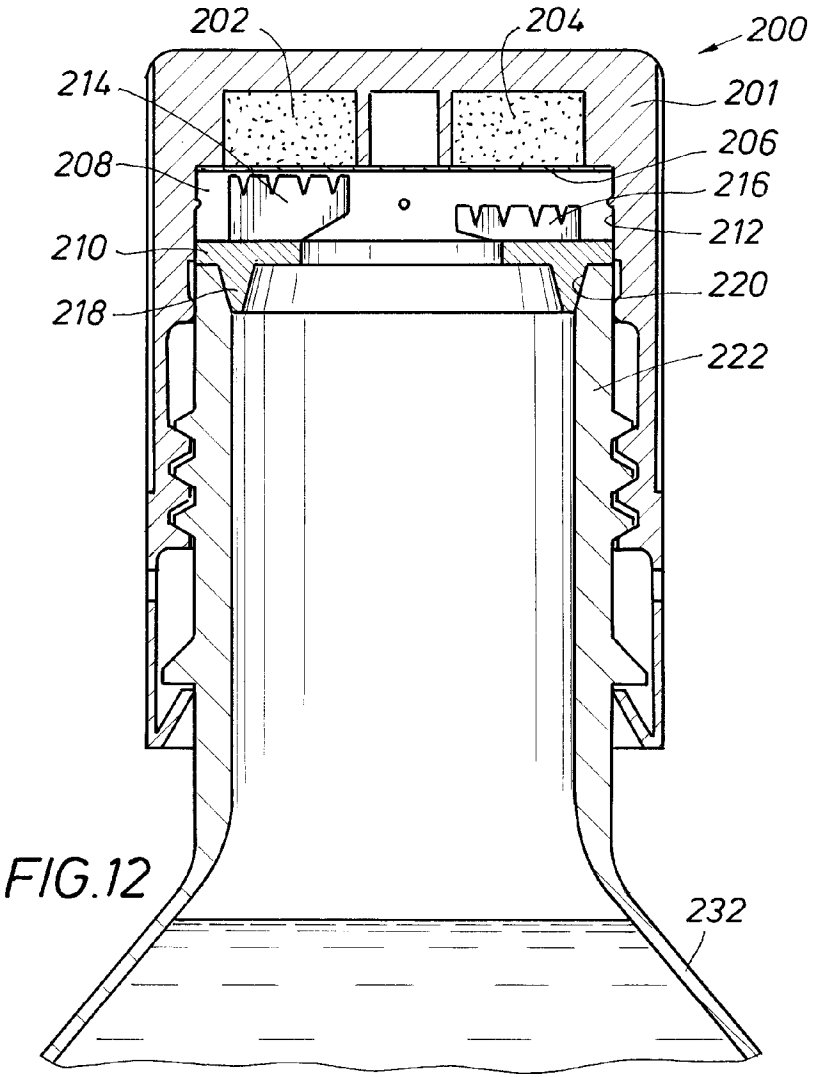
FIG. 12 is a cross-sectional view of another preferred embodiment including two compartments closed by a membrane.

When clockwise torque is applied to the cap 201, as shown by an arrow 221 in FIG. 13, the cap assembly 200 moves down on the bottle neck 222, but the ring plate 210 is supported by the top edge of the bottle neck 222 and thus the cutting blade 214 cuts into the membrane 206. The conical protrusion 218 provides enough friction in chamfer 220 to prevent the ring plate 210 from rotating with the cap 201 and causes the blade 214 to tear open the membrane 206 under the first compartment 202, while cutting blade 216 moves into closer proximity to membrane 206 under the second compartment 204.

At this point, the ring plate 210 has reached detent protrusions 224, which provide a noticeable increase in resistance to the clockwise torque, indicating that the second compartment 204 is about to be opened, if the applied torque is increased. This situation is illustrated in FIGS. 13 and 15.

If the user continues to apply clockwise torque to the cap 201, the blade 216 penetrates the membrane 206 beneath the second cavity 204. FIG. 14 shows this process completed; with both compartments 202 and 204 opened. The additives contained in both have been dumped into a liquid 230 in a bottle 232.

It may be desirable to provide an additive in liquid form, such as for example certain liquid medications. FIGS. 16 through 19 illustrate another preferred embodiment of the invention, i.e. a cap assembly 300 which is particularly suited to use an additive in liquid form, which is contained in a bladder-like capsule.

Figure 18:
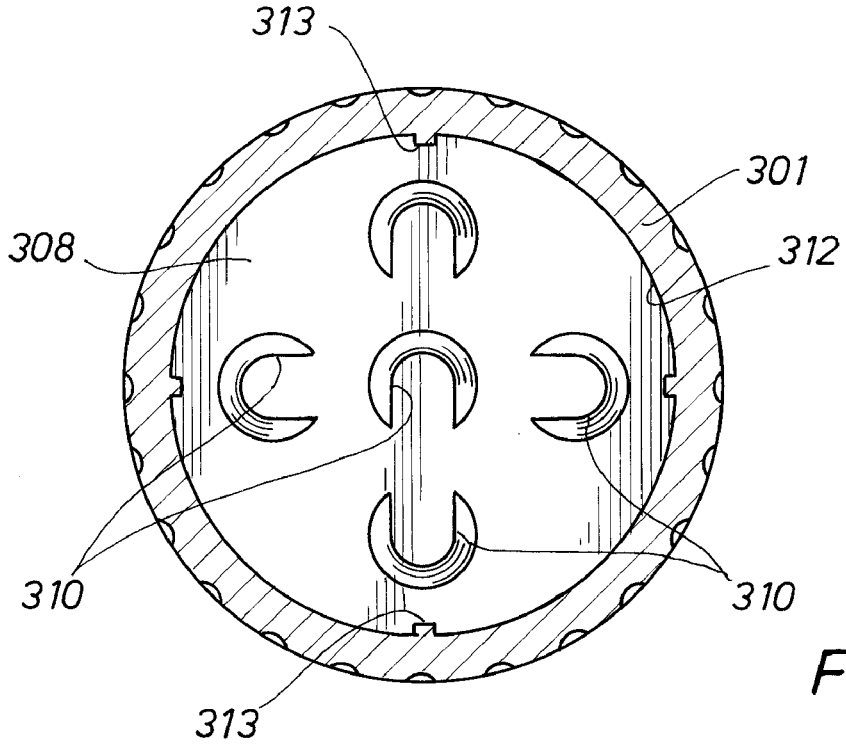
FIG. 18 is a cross-sectional view taken along section lines 18-18 of FIG. 16.
Figure 19:
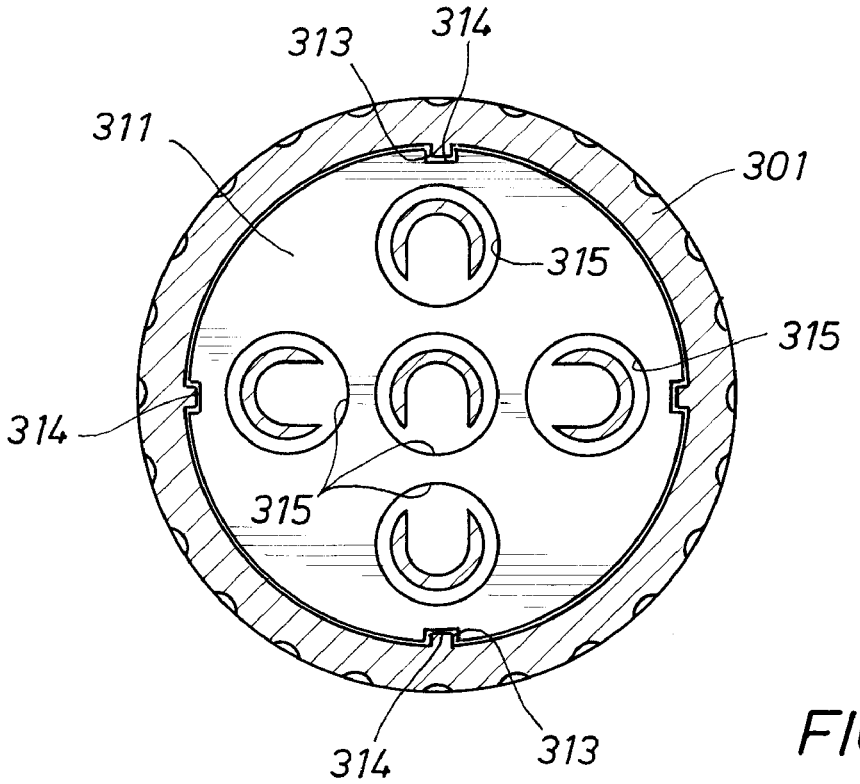
FIG. 19 is a cross-sectional view taken along section lines 19-19 of FIG. 17.

The cap assembly 300 includes a cap 301 which defines a cavity 302, enclosing a bladder 304 which retains a quantity of a liquid additive 306. The cap 301 includes a top plate 308, including a plurality of downwardly protruding circular cutting edges 310. The cutting edges are open to one side, as best seen in FIG. 18. The bladder 304 is held in close proximity to the cutting edges 310 by a perforated plate 311, which is perforated by a plurality of perforation holes 315 and slidably held inside a cavity wall 312. The perforated plate 311 is prevented from rotating by keys 313 (FIG. 18) straddled by keyways 314 and the plate 311. This feature keeps the perforation holes 315 in plate 311 in alignment with cutting edges 310.

Figure 17:
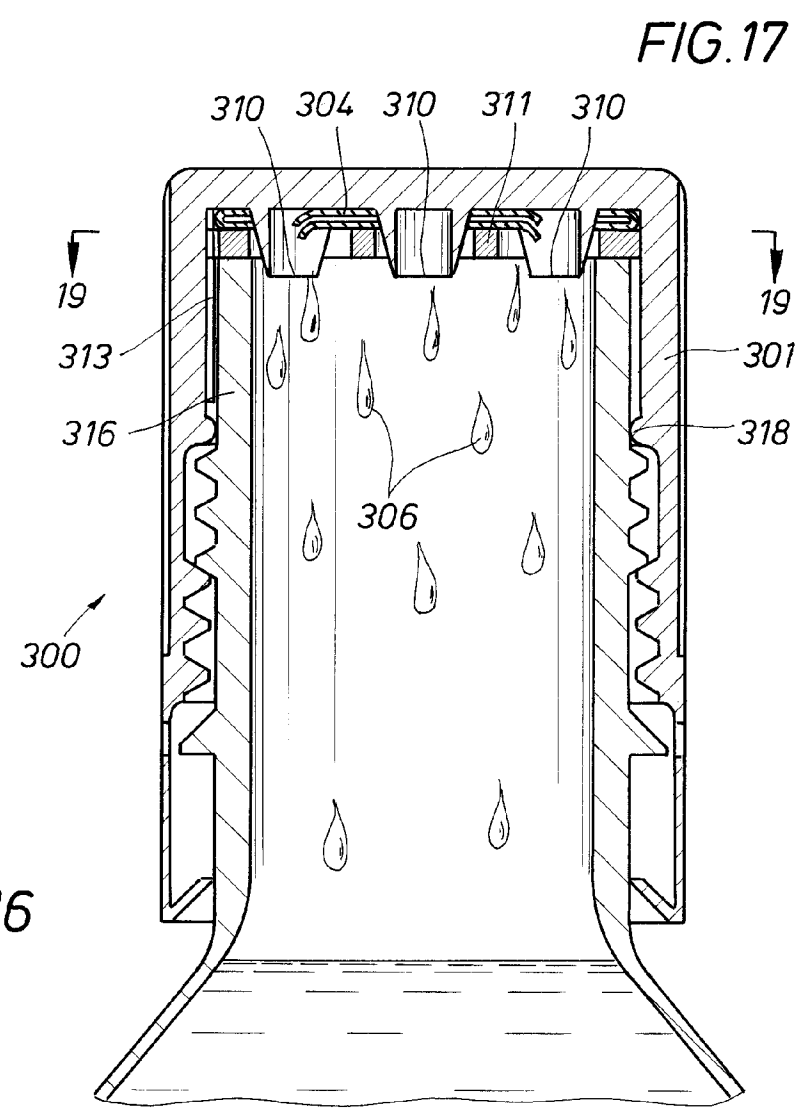
FIG. 17 is a cross-sectional view of a bottle cap rotated clockwise with the bladder penetrated and compressed, thereby pressing the liquid out of the bladder.
Figure 16:
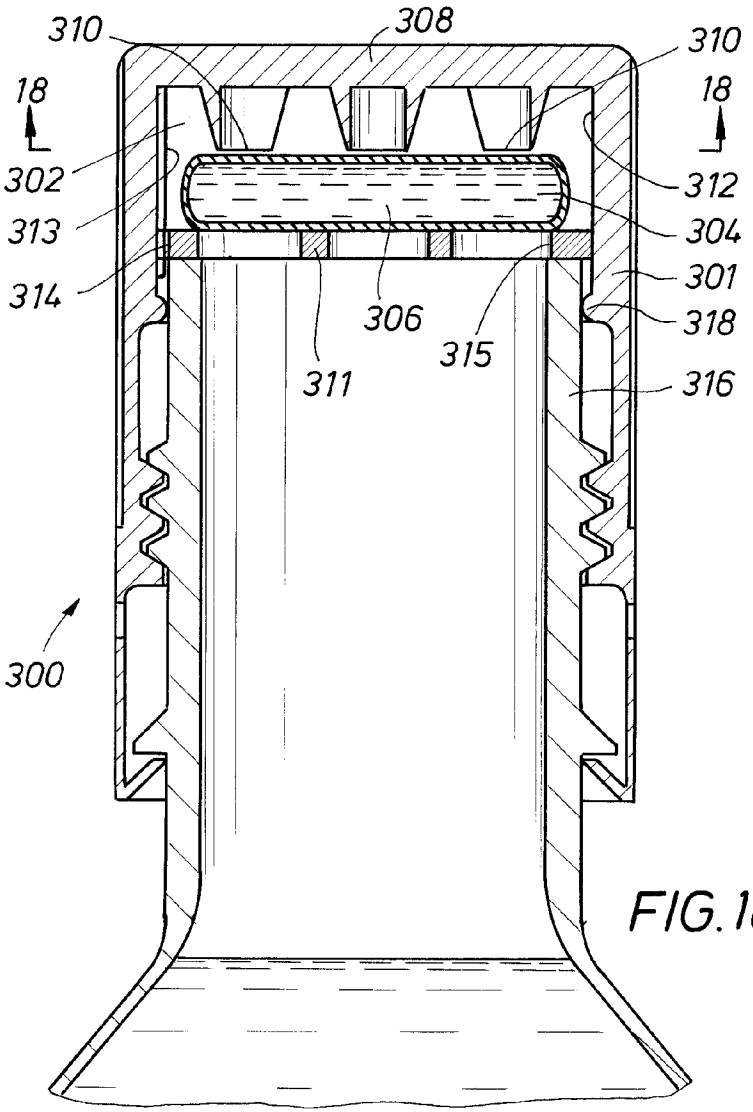
FIG. 16 is a cross-sectional view of another preferred embodiment including an additive in liquid form contained within a bladder.

As clockwise torque is applied to the cap 301, it is moved downward onto a bottle neck 316, thereby forcing cutting edges 310 to slice through the bladder 304, and squeezing additive contents out of the bladder 304, as illustrated in FIG. 17. All this happens while a sealing bead 318 slides along the outer surface of the bottle neck 316, preventing any contents from leaking from the bottle.

It will be readily apparent to those of skill in the art that many other structures may be used to retain a quantity of an additive within a bottle cap for release by a user. For example, a plunger may be deployed from the top of the bottle cap down into a membrane retaining the additive. Furthermore, multiple cavities may be used to tailor the amount of the additive to be dissolved within the liquid in the bottle, and a plurality of different additives may be retained within the bottle cap.

The chamber or cavity may also be used to enclose other types of additives. For example, some users may wish additional vitamins, caffeine, sugar, artificial sweetener, lemon extract, vanilla, cherry flavoring, or other types of additives commonly used in soft drinks. The present invention is particularly well adapted to including one or a plurality of these types of additives, if desired. Furthermore, the chamber of cavity may be positioned within a bottom of the bottle, rather than in a cap, if desired, fully within the scope and spirit of the present invention.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A beverage dispenser comprising:

a. a bottle having a threaded neck, wherein the bottle is adapted to retain a quantity of a liquid; and b. a bottle cap assembly comprising i. a rotatable outer cap forming a chamber for retaining a quantity of additive, the rotatable outer cap comprising an inner concentric barrel with at least one downwardly extending tooth and the rotatable outer cap also having at least one inwardly extending protrusion;

ii. an inner cap for threadably engaging the threaded neck of the bottle and the inner cap having a J-slot for engaging the at least one inwardly extending protrusion within the outer cap, wherein a molded lip formed on the inner cap presses the inner concentric barrel of the outer cap sealing the upper end of the chamber;

iii. a penetrable membrane between the chamber and the quantity of a liquid, wherein the penetrable membrane is in fluid communication with the quantity of a liquid;

iv. a seal ring in contact with a top of the threaded neck of the bottle and the penetrable membrane, the seal ring providing an interference fit within the bottle neck, wherein the penetrable membrane forms a seal across the seal ring thereby forming a lower seal for the chamber across the area of the threaded neck of the bottle;

v. the J-slot formed in an outside surface of the inner cap, wherein the at least one inwardly extending protrusion formed in the outer cap extends into the J-slot and is adapted to define relative movement between the inner and outer caps; and vi. wherein the J-slot has at least one knuckle for retaining the at least one inwardly extending protrusion;

wherein the rotatable outer cap rotates around the inner cap enabling the at least one inwardly extending protrusion of the outer cap to move toward the end of the J-slot enabling the at least one tooth to pierce the penetrable membrane allowing the additive to mix with the quantity of fluid and the rotatable inner cap rotates the at least one inwardly extending protrusion of the outer cap toward the opposite end of the J-slot enabling twisting of the inner cap off the threaded neck of the bottle.

2. The dispenser of claim 1, further comprising at least two teeth extending down from the underside of the outer cap and adapted to penetrate the membrane upon relative movement between the inner and outer caps.

3. The dispenser of claim 2, wherein clockwise movement between the inner and outer caps causes the at least one tooth to penetrate the membrane.

4. The dispenser of claim 1, further comprising a tamper indicator formed in the bottle cap.

* * * * *